US005724694A

United States Patent [19]

Lewis

[11] Patent Number: 5,724,694

[45] Date of Patent: Mar. 10, 1998

[54] SELF-SQUEEZING MOP

[76] Inventor: Larry I. Lewis, 2612 Saxon Pl., Rockford, Ill. 61114

[21] Appl. No.: 781,652

[22] Filed: Jan. 10, 1997

[51] Int. Cl.[6] ..... A47L 13/44

[52] U.S. Cl. ..... 15/119.1; 15/262

[58] Field of Search ..... 15/119.1, 119.2, 15/120.1, 120.2, 116.1, 116.2, 262, 260

[56] References Cited

U.S. PATENT DOCUMENTS

| | | | |
|---|---|---|---|
| 1,709,622 | 4/1929 | Justis | 15/120.2 |
| 3,364,512 | 1/1968 | Yamashita et al. | 15/119.1 |
| 3,462,788 | 8/1969 | Abbott | 15/119.1 |
| 3,946,457 | 3/1976 | Robinson | 15/119.1 |
| 4,114,224 | 9/1978 | Disko | 15/229.1 |
| 4,809,387 | 3/1989 | Nakamura et al. | 15/119.1 |
| 5,060,338 | 10/1991 | Yates et al. | 15/119.1 |
| 5,509,163 | 4/1996 | Morad | 15/120.2 |

FOREIGN PATENT DOCUMENTS

| | | | |
|---|---|---|---|
| 716584 | 12/1931 | France | 15/119.1 |
| 589192 | 2/1959 | Italy | 15/119.1 |
| 13540 | of 1904 | United Kingdom | 15/119.1 |
| 7966 | of 1909 | United Kingdom | 15/119.1 |
| 185941 | 9/1922 | United Kingdom | 15/116.1 |
| 1300709 | 12/1972 | United Kingdom | 15/120.1 |

*Primary Examiner*—Gary K. Graham
*Attorney, Agent, or Firm*—Leydig, Voit & Mayer, Ltd.

[57] ABSTRACT

A self-squeezing mop employing a linear squeezing action to remove liquid carried by stranded, non-woven absorbent material. The mop has a mop head attached to a handle and a cylinder which travels between extended and retracted positions. A squeeze ring is located on one end of the cylinder and is sized to compress and shape the stranded absorbent material as it travels from the retracted to the extended position. The squeeze ring comprises a plurality of angularly disposed stationary rollers. The rollers have contact surfaces which engage and compress the strands of the mop head. The strands are made of non-woven material with sufficient body to resist bunching in the cylinder as the cylinder moves from the extended to the retracted position.

14 Claims, 2 Drawing Sheets

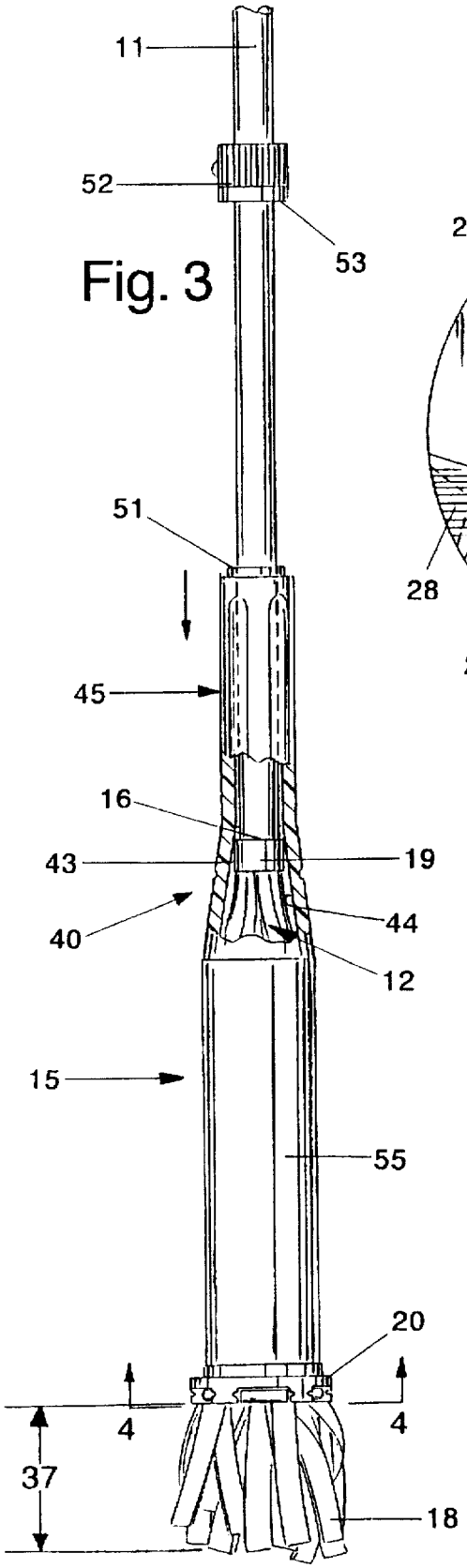
Fig. 3
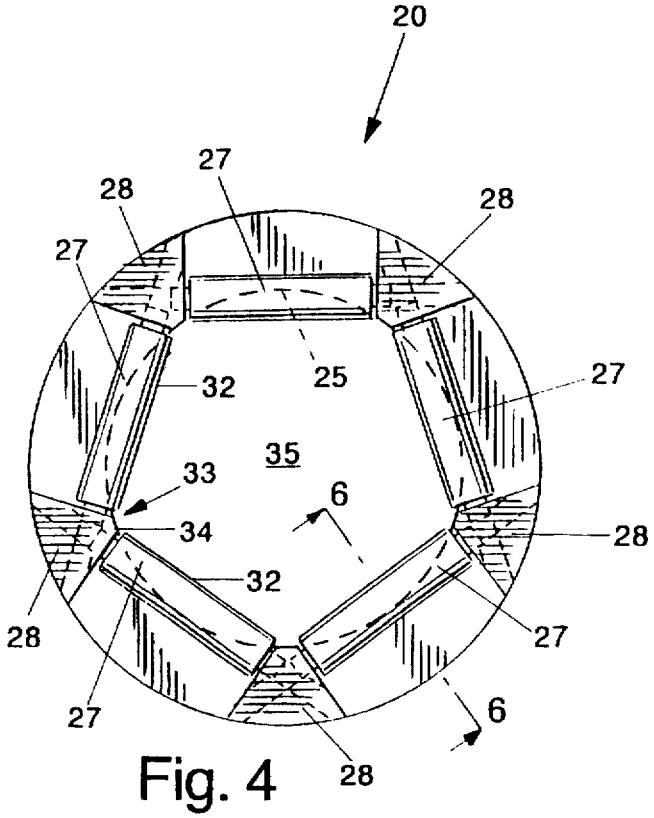
Fig. 4
Fig. 5
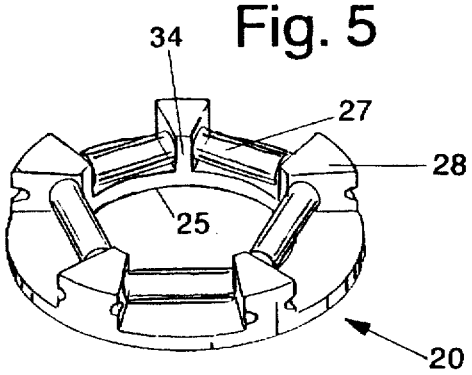
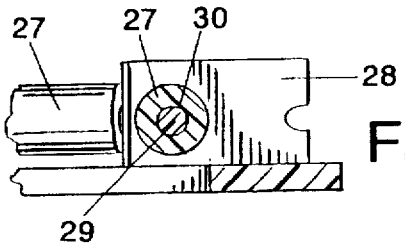
Fig. 6

SELF-SQUEEZING MOP

FIELD OF THE INVENTION

The present invention generally relates to mops with integrally provided apparatus for removing liquid from the mop, and more particularly relates to self-squeezing mops.

BACKGROUND OF THE INVENTION

As is generally known, mops are used in a number of applications to clean surfaces. Unfortunately, the common mop is difficult and cumbersome to use. During mopping operations, the user must immerse the absorbent end of the mop into a cleaning solution. Typically, wringing or twisting is used to remove some of the liquid from the absorbent material before mopping. A separate wringer or squeezer is often used to drain the mop head. The conventional mop, therefore, requires multiple pieces of apparatus in order to be effectively used.

Many self-wringing mops have been proposed to eliminate the need for additional apparatus during mopping operations. These devices typically incorporate a wringer directly on the mop. The wringer twists the mop in a wringing motion so that liquid drains from the absorbent material. The amount of liquid drained from a typical self-wringing mop generally corresponds to the amount of force exerted on the mop. Accordingly, typical self-wringing mops require significant physical exertion and therefore may be difficult for some people to operate.

In addition, self-wringing mops commonly require multiple operations to wring the mop. For example, a self-wringing mop may require the user to engage one end of the mop with a twisting member, apply rotational force to the twisting member thereby wringing the strands, return the twisting member to its original position, and unlock the mop end from the twisting member to resume mopping. The number of steps required to drain a typical self-wringing mop therefore renders such devices overly time consuming.

Some mops use an outer cylinder to wring or squeeze the mop head. These mops have additional problems with tangling and bunching of stranded or stringed absorbent material as the cylinder is actuated. Some absorbent material, such as stringed cotton, is relatively limp and therefore may tangle or bunch during wringing or squeezing. As a result, it is difficult or impossible to disengage the outer cylinder from the mop head.

SUMMARY OF THE INVENTION

In view of the foregoing, it is a general aim of the present invention to provide a self-squeezing mop which uses a linear squeezing action to remove liquid from the non-woven strands of an absorbent mop head without bunching the strands during squeezing operations.

In that regard, it is an object of the present invention to provide a self-squeezing mop which has a squeeze ring adapted for longitudinal movement along the strands of a mop head.

It is a detailed object of the present invention to provide a self-squeezing mop which limits the distance the squeeze ring travels along the strands of the mop head.

It is a detailed object of the present invention to provide a self-squeezing mop which provides easy and convenient means for locking the squeeze ring in a retracted position.

It is also a detailed object of the present invention to provide a self-squeezing mop in which the user can selectively control the amount of liquid removed from the mop according to the distance with which the squeeze ring is moved along the mop strands.

Accordingly, it is a feature of the present invention to provide a self-squeezing mop comprising compressing means disposed on a mop end of a hollow cylinder, the compressing means adapted to travel along the length of and squeeze the stranded absorbent material, thereby using a linear squeezing action to remove liquid carried by the strands. The stranded absorbent material is made of non-woven fibers having sufficient body to resist bunching or tangling as the cylinder is returned to the retracted position.

A detailed feature of the present invention is to provide a self-squeezing mop in which the compressing means comprises a plurality of rollers spaced angularly about the axis of the cylinder, the rollers being arranged so that the stranded absorbent material is compressed as it passes through the squeeze ring. It is a further feature of the present invention that the rollers are mounted for free rotation. Accordingly, the rollers are driven by the strands as the strands pass through the squeeze ring.

Another detailed feature of the present invention is to provide a self-squeezing mop in which the mop head has a plug which abuts a neck of the cylinder to define the extended position of the cylinder.

These and other objects and advantages of the invention will become more apparent from the following detailed description when taken in conjunction with the accompanying drawings.

BRIEF DESCRIPTION OF THE DRAWINGS

FIG. 3 is an enlarged side view of the mop of FIG. 1 in the extended position with a partial sectional view of the plug and neck.

FIG. 4 is an enlarged view of the mop taken along line 4—4 of FIG. 3.

FIG. 5 is an enlarged perspective view of the squeeze ring shown in FIG. 4.

FIG. 6 is an enlarged section view of the squeeze ring taken along line 6—6 of FIG. 5.

Figure 1:
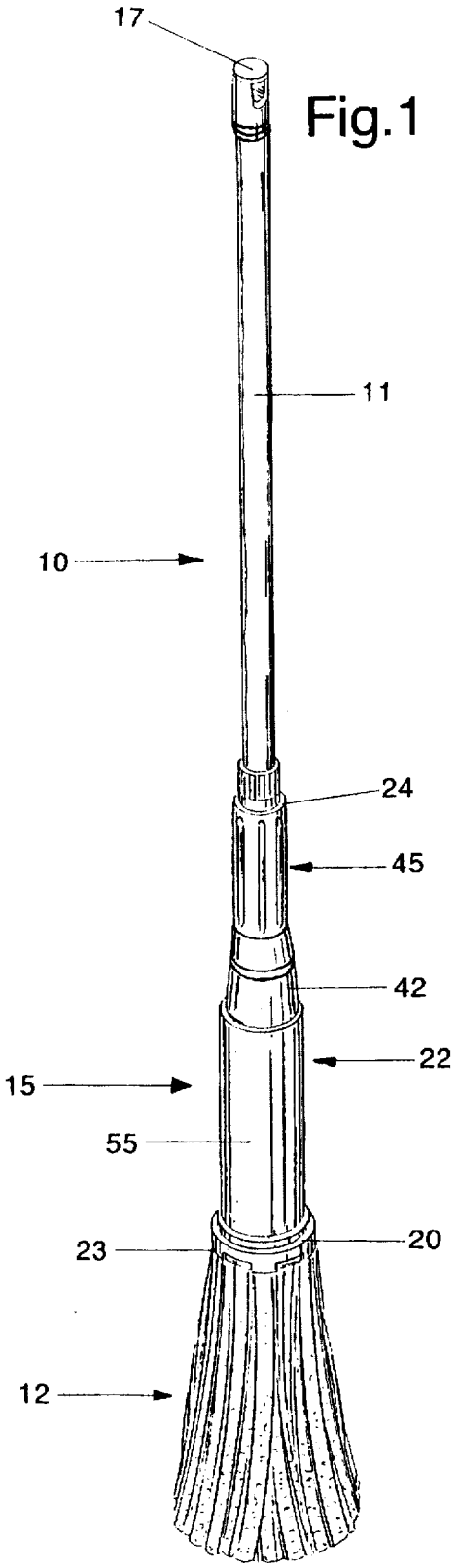
FIG. 1 is a perspective view of a self-squeezing mop in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

For purposes of illustration, the invention is shown in FIG. 1 as embodied in a self-squeezing mop 10 having a handle 11, mop head 12, and squeeze assembly indicated generally at 15. As described more fully below, the squeeze assembly 15 travels along a length of the mop head 12, thereby draining an amount of liquid from the mop head 12.

The handle 11 is provided for manipulating the mop 10 in mopping or swabbing operations. As illustrated in FIG. 1, the handle 11 comprises an elongate cylindrical rod of conventional length and comprising first 16 and second 17 ends. The first end 16 of the handle 11 is adapted for removably attaching the mop head 12. Space for gripping the mop 10 with two hands is provided near the second end 17. The handle 11 is further configured to center the squeeze assembly 15 with the mop head 12 and guide the movement of the squeeze assembly 15 along the mop head 12, as discussed in greater detail below.

The mop 10 includes a mop head 12 of stranded, non-woven fiber material 18 for absorbing liquid and assisting in squeezing operations described more fully below. The elongate strands 18 are attached to one side of the plug 19. The opposite side of the plug 19 is adapted to be removably attached to the first end 16 of the handle 11 and is preferably threaded. Free ends of the strands 18 are unsecured, allowing the strands 18 to act as a typical mop head. The flexible non-woven strands 18 adapt to a number of surfaces and are capable of conform to hard to reach areas such as crevices and corners. The non-woven material also allows the strands to be shaped by the squeeze assembly 15, thereby facilitating movement of the squeeze assembly 15 from an extended to a retracted position, as described more fully below. In the preferred embodiment, the strands 18 of non-woven material are approximately ¾" wide and 11" long. Furthermore, the strands preferably have a dry density between 140 to 240 grams per square meter.

In practicing the invention, the squeeze assembly 15 is manipulated along the length of the mop head 12, thereby draining liquid from the strands 18. The squeeze assembly 15 is first moved through a down stroke, in which the assembly 15 travels along the handle 11 and engages the strands 18, from a retracted to an extended position. During the down stroke, the squeeze assembly 15 employs a linear squeezing action to drain liquid from the strands 18. As the squeeze assembly 15 travels in a return stroke from the extended position to the retracted position, the strands 18 slide past the assembly 15 without bunching.

In the preferred embodiment, the squeeze assembly 15 comprises a squeeze ring 20 carried on a hollow cylinder 22 for movement along the first end 16 of the handle 11. As shown in FIG. 1, the elongate cylinder 22 is disposed along an axis and includes squeeze 23 and grip 24 ends. The squeeze ring 20 is located at the squeeze end 23. In the retracted position (shown in FIGS. 1 and 2), the squeeze end 23 of the cylinder 22 is located adjacent to the first end 16 of the handle 11, thereby allowing the strands 18 to spread out during mopping or swabbing. Means are provided in the preferred embodiment for locking the cylinder 22 in the retracted position, as described more fully below. In the extended position (shown in FIG. 3), the squeeze end 23 of the cylinder 22 is located at a point along the attached mop head 12 such that the strands 18 overhang the squeeze ring 20. When the cylinder 22 reaches the extended position, the strands 18 are squeezed to the extent possible by the squeeze ring 20.

As shown in FIGS. 4 and 5, the squeeze ring 20 has an inner diameter 25 disposed about the axis of the cylinder 22 comprising a plurality of rollers 27 and arms 28 disposed radially about the axis for compressing the strands 18. Each cylindrical roller 27 is mounted for rotation about a stationary axle 29 (FIG. 6). In the preferred embodiment, ends of the axles 29 are carried by bores 30 in the arms 28. Accordingly, the rollers 27 are restricted to rotational, rather than axial or lateral, movement.

In the preferred embodiment, each roller 27 has a contact surface 32 disposed within the inner diameter 25 of the ring 20 for compressingly engaging the non-woven strands 18. As best shown in FIG. 4, the contact surface 32 is the innermost edge of the roller 27 disposed nearest the axis of the cylinder 22. It will be appreciated that the rollers 27 are mounted for free rotation and, accordingly, are driven by the relative movement of the strands 18 as the cylinder 22 executes down or return strokes.

The arms 28 are provided not only for holding the rollers 27 but also for filling gaps 33 located between adjacent rollers 27. As best shown in FIG. 5, the arms 28 depend from the ring 20 at radially spaced locations. In the preferred embodiment, the arms 28 have a triangular or wedge-shaped structure. Each arm 28 has a flat inner face 34 disposed substantially along the inner diameter 25 of the ring 20. As best shown in FIG. 4, the inner faces 34 substantially fill the axial space 33 between contact surfaces 32 of adjacent rollers 27.

From the above it will be appreciated that the rollers 27 and arms 28 define an axial path 35 through which the stranded absorbent material 18 may pass. The axial path 35 is substantially bounded by the contact surfaces 32 of the rollers 27 and the inner faces 34 of the arms 28. The axial path 35 is sized so that the stranded absorbent material 18 is compressed as it passes through the squeeze ring 20.

It will further be appreciated that the axial path 35 shapes the stranded material 18 to facilitate movement of the cylinder 22 from the extended to the retracted position. As noted above, the non-woven strands 18 are flexible yet have sufficient body retain a given shape. Accordingly, when the squeeze ring 20 is forced along the length of the strands 18, the strands compress to form a shape substantially similar to that of the axial path 35. As a result, the strands 18 provide less resistance to the squeeze ring 20 on the return stroke.

In the preferred embodiment, five rollers 27 are provided in the squeeze ring 20 for facilitating the return stroke of the cylinder 22 (FIGS. 4 and 5). It will be appreciated that the potential for tangling is reduced as the angle between adjacent rollers 27 increases. Adjacent rollers 27 should define an angle at least 90 degrees to avoid excessive tangling of the strands 18. It will be appreciated, however, that more rollers 27 are required to line the entire circumference of the squeeze ring 20 when the angle between adjacent rollers is increased. As a result, the number of discontinuities or gaps 33 between adjacent rollers is increased, resulting in increased potential for tangling. Furthermore, manufacturing costs rise with the number of rollers 27. Thus, performance and economical concerns limit the number of rollers which may be incorporated into the squeeze ring 20. Accordingly, while the present invention contemplates the use of a greater or lesser number of rollers 27, it has been found that a squeeze ring 20 incorporating 5 rollers 27 balances performance and economic concerns.

It will be appreciated that, in accordance with a detailed aspect of the present invention, the squeeze assembly 15 allows the user to selectively control the amount of liquid drained from the mop. As noted above, the squeeze ring 20 compresses the strands 18 when actuated in a down stroke. The amount of liquid drained from the strands 18 corresponds to the length of strands 18 compressed by the squeeze ring 20. Accordingly, the user may control the amount of liquid squeezed from the mop according to the distance the squeeze assembly 15 is actuated. In the preferred embodiment, the squeeze ring 20 is sized so that the amount of liquid drained from the mop head 12 is 15 to 25 percent.

It will be appreciated that some amount of strand overhang 37 is required in order to avoid bunching of the strands 18 as the cylinder 22 executes a return stroke. If the cylinder 22 travels too close to the ends of the strands 18, the strand ends will buckle and bunch when force is applied to return the cylinder 22 to the retracted position. As a result, it becomes difficult or impossible to return the cylinder to the retracted position. It has been found that an overhang 37 of at least one inch is sufficient to resist bunching or tangling as the cylinder 22 moves from the extended to the retracted position when using a stranded mop made of non-woven material. In the most preferred embodiment, the strand overhang 37 is 2 inches.

The mop preferably incorporates integral stopping means 40 for regulating the extended position of the cylinder 22. As shown in FIG. 3, the stopping means 40 comprise the plug 19 of the mop head 12 and a frustoconical neck 42 located on the cylinder 22 between the squeeze and grip ends (FIG. 3). The plug 19 has an outside diameter 43 which abuts the inside surface 44 of the neck 42. The abutting engagement between the plug and the neck prevents the cylinder 22 from traveling further in the extended direction. Accordingly, the stopping means 40 defines the extended position of the cylinder 22. In the preferred embodiment, as indicated above, the stopping means 40 is located so the strand overhang 37 is at least one inch.

A grip portion 45 is provided on the grip end 24 of the cylinder 22 for allowing the user to conveniently perform squeezing operations. As shown in FIG. 1, the generally cylindrical grip portion 45 has a plurality of recessed grooves 46 disposed about an outer diameter 47 for enhanced gripping. The outer diameter 46 of the grip portion 45 is sized to accommodate the user's hand. The grip portion is disposed closer to the second end 17 of the handle 11, where the user's hands are positioned during mopping operations. It will be appreciated that the grip portion 45, therefore, allows the user to conduct mop squeezing operations without excessive bending.

Figure 2:
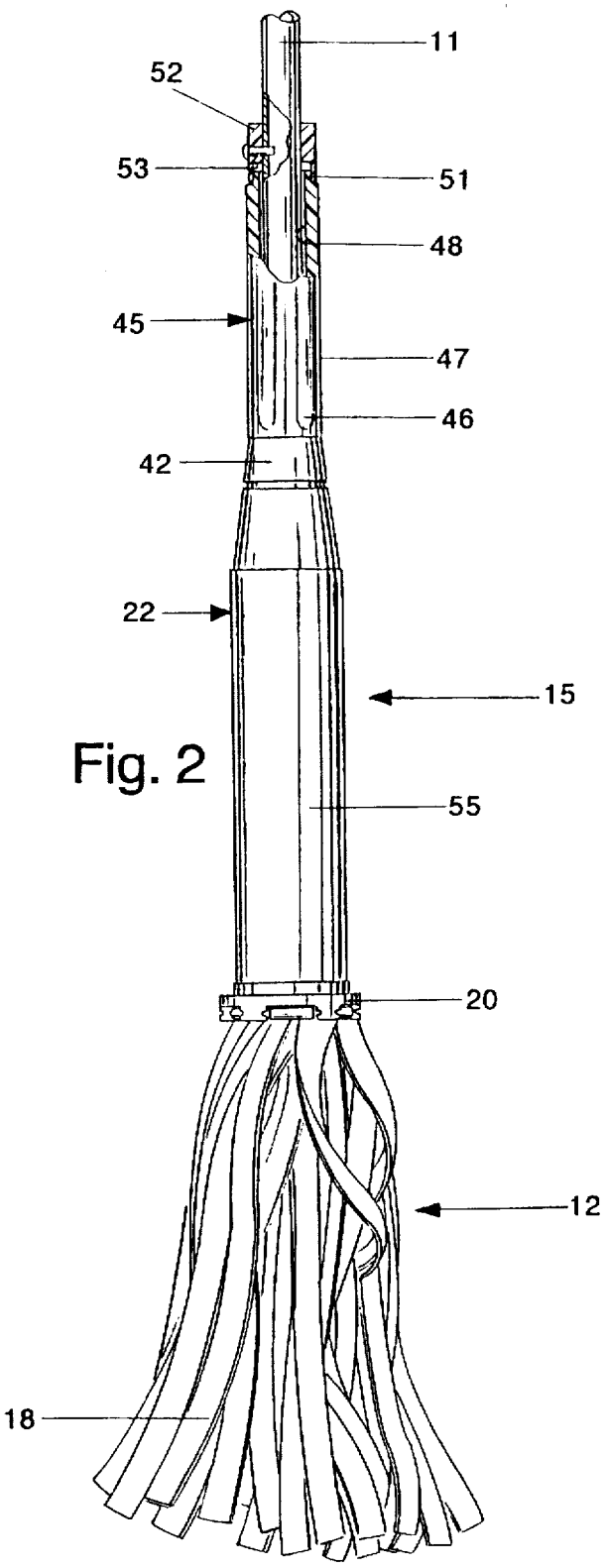
FIG. 2 is an enlarged side view of the mop of FIG. 1 in the retracted position and showing partial sectional view of the grip end of the cylinder.

In the preferred embodiment, the grip portion 45 of the cylinder 22 is further configured for centering the squeeze ring 20 with the mop head 12 and axially guiding the cylinder along the handle 11 as it travels between the extended and retracted positions. As illustrated in FIGS. 2 and 3, the grip portion 45 preferably has a cylindrical inside wall 48 which substantially conforms to the cylindrical outside surface of the handle 11. The grip portion 45 is coaxially aligned with the squeeze ring 20 of the cylinder 22. Accordingly, the squeeze ring is substantially centered with the handle 11 and mop head 12. In addition, the close conformity of the grip portion 45 with the handle 11 guides the cylinder 22 as it moves longitudinally along the handle 11.

In accordance with a detailed object of the present invention, holding means 50 are provided for locking the cylinder 22 in the retracted position. In the preferred embodiment, the holding means 50 comprises the frictional engagement of a lip 51 and a collar 52. As illustrated in FIG. 2, a cylindrical lip 51 extends axially from the grip end 24 of the cylinder 22. A collar 52 is located on the handle 11 at a point between the first 16 and second 17 ends. The collar 52 has an annular groove 53 facing the second end sized to receive the lip 51. In operation, the lip 51 is forced into and frictionally engages the groove 53, thereby holding the cylinder 22 in the retracted position.

The cylinder 22 further comprises a housing portion 55 for shielding the strands 18 after being drained by the squeeze ring 20. As shown in FIG. 3, the housing portion 55 is sufficiently long to encompass a length of the strands 18 after being compressed. The housing 55, accordingly, keeps the strands 18 from becoming resaturated with liquid, thereby avoiding additional bunching during the return stroke of the cylinder 22. In addition, the interior wall of the housing portion 55 is smooth so that the strands do not snag during squeezing operations. In the preferred embodiment, the housing 55 portion is cylindrical.

It will now be appreciated that what has been provided is an improved self-squeezing mop. The mop comprises a mop head attached to a handle and a cylinder which travels between and extended and retracted position. The mop head is made of stranded, non-woven material of sufficient body to resist bunching in the cylinder as the cylinder travels from the extended to the retracted position. The cylinder has a squeeze ring located on the mop end and sized to compress the stranded absorbent material of the mop head. The mop preferably uses a plurality of rollers to compress and shape the stranded absorbent material. As a result, the cylinder is capable of traveling from the extended to the retracted position without tangling the strands. The mop incorporates stopping means for regulating the extended position of the cylinder so that at least one inch of the strands overhangs the squeeze ring.

What is claimed is:

1. A self-squeezing mop comprising:

an elongate handle including first and second ends, a mop head including non-woven stranded absorbent material releaseably attached to the first end of the handle, a hollow cylinder disposed about an axis and mounted substantially coaxially for longitudinal movement along a portion of the handle near the first end between a retracted position and an extended position, the cylinder having a squeeze end and a grip end, the squeeze end substantially adjacent to the first end in the retracted position, and the squeeze end located beyond the first end in the extended position, and a squeeze ring on the squeeze end for compressing the absorbent material, the squeeze ring carrying a plurality of rollers spaced angularly about the axis, the rollers arranged to compress the absorbent material as the cylinder travels from the retracted to the extended position, thereby using a linear squeezing action to remove an amount of liquid carried by the absorbent material, the absorbent material having sufficient body to avoid bunching in the cylinder as the cylinder travels from the extended to retracted position.

2. The mop of claim 1 in which the squeeze ring has an annular shape defining an inner diameter, each roller of the squeeze ring having a contact surface located within the inner diameter.

3. The mop of claim 2 in which the ring comprises a plurality of axially depending, wedge shaped arms located between adjacent rollers, each arm including means for carrying the rollers and an inner face disposed parallel to the axis for substantially filling a gap between the contact surfaces of adjacent rollers.

4. The mop of claim 2 in which the contact surfaces of adjacent pairs of rollers define an angle of at least 90 degrees.

5. The mop of claim 4 in which the squeeze ring holds 5 rollers angularly spaced about the holder.

6. The mop of claim 1 in which stopping means are provided for limiting the extended position of the cylinder, the stopping means located so that at least 1 inch of the strands overhangs the squeeze ring when the cylinder is in the extended position.

7. The mop of claim 6 in which the stopping means comprise a plug on the mop head and a neck located on the cylinder between the squeeze and grip ends, the neck sized to prevent passage of the plug, thereby preventing the cylinder from traveling past the extended position.

8. The mop of claim 7 wherein the non-woven material has a density of 140 to 240 grams/square meter.

9. The mop of claim 1 in which a cylindrical lip extends axially about the grip end of the cylinder and a collar is located on the handle, the collar having an annular groove for receiving the lip of the cylinder, the lip sized to frictionally engage the groove, thereby locking the cylinder in the retracted position.

10. The mop of claim 1 in which the squeeze ring is adapted to remove liquid from the absorbent material according to a longitudinal extent the squeeze ring travels along the absorbent material, the squeeze ring adapted to remove between 15 to 25 percent of the liquid when the absorbent means is fully saturated.

11. A self-squeezing mop comprising:

an elongate handle including first and second ends, a mop head including non-woven stranded absorbent material releaseably attached to the first end of the handle, a hollow cylinder disposed about an axis and mounted substantially coaxially for longitudinal movement along a portion of the handle near the first end between a retracted position and an extended position, the cylinder having squeeze and grip ends, the squeeze end substantially adjacent to the first end when in the retracted position, and the squeeze end located beyond the first end when in the extended position, a squeeze ring mounted on the cylinder, the squeeze ring having rollers defining an axial path for passage of the absorbent material, the axial path having a size adapted to compress the absorbent material to squeeze out water as the cylinder travels from the retracted to the extended position, the absorbent material having sufficient body to avoid bunching in the cylinder as the cylinder travels from the extended to retracted position.

12. The mop of claim 11 in which the squeeze ring has an inner diameter disposed about the axis and comprises a plurality of rollers spaced angularly about the axis, each roller having a contact surface located within the inner diameter.

13. The mop of claim 12 in which the squeeze ring comprises a plurality of axially depending, wedge shaped arms located between adjacent rollers, each arm including means for carrying the rollers and an inner face disposed parallel to the axis for substantially filling a gap between the contact surfaces of adjacent rollers, the contact surfaces and inner faces thereby defining the axial path.

14. The mop of claim 13 in, which the squeeze ring comprises 5 rollers and 5 arms.

* * * * *